United States Patent [19]

Burhoe

[11] Patent Number: 4,783,872

[45] Date of Patent: Nov. 15, 1988

[54] FLOOR AND BASEBOARD TREATING MACHINE

[75] Inventor: Herbert G. Burhoe, Amarillo, Tex.

[73] Assignee: The 3J Company, Victoria, Tex.

[21] Appl. No.: 934,902

[22] Filed: Nov. 25, 1986

[51] Int. Cl.[4] ..... A47L 11/162; A47L 11/18

[52] U.S. Cl. ..... 15/98; 15/49 R; 15/49 C; 51/177; 51/170 T

[58] Field of Search ..... 51/176, 174, 170 R, 51/170 T, 170 PT, 177; 15/98, 49 R, 49 C, 3.0, 50 R, 385; 180/19.1, 19.2, 19.3, 320; 474/148, 150

[56] References Cited

U.S. PATENT DOCUMENTS

| | | | |
|---|---|---|---|
| D. 282,110 | 1/1986 | Tucker et al. | 15/49 R X |
| 1,434,109 | 10/1922 | Finnell | 15/49 R |
| 1,588,157 | 6/1926 | Beach | 51/170 R |
| 1,609,508 | 12/1926 | Cavicchi | 15/49 R X |
| 1,626,742 | 5/1927 | Lockwood | 15/98 |
| 1,668,692 | 5/1928 | Miskimen | 15/49 R |
| 2,348,268 | 5/1944 | Smith | 15/49 R |
| 2,417,620 | 3/1947 | Soderberg | 15/98 |
| 2,435,192 | 2/1948 | Arsneau | 180/19.1 X |
| 2,684,495 | 7/1954 | Litkenhous | 15/49 R |
| 2,702,395 | 2/1955 | Zaiger | 15/98 |
| 3,277,511 | 10/1966 | Little | 15/320 |
| 3,327,338 | 6/1967 | Young | 15/98 |
| 3,715,772 | 2/1973 | Downing et al. | 15/49 RB |
| 3,731,334 | 5/1973 | Carbonell | 15/50 R |
| 4,122,576 | 10/1978 | Bevington et al. | 15/49 R |
| 4,358,868 | 11/1982 | Cook, Jr. | 15/49 R |
| 4,365,377 | 12/1982 | Todd et al. | 15/98 |
| 4,399,578 | 8/1983 | Bordeaux | 15/97 R |

FOREIGN PATENT DOCUMENTS

| | | | |
|---|---|---|---|
| 562085 | 5/1975 | Switzerland | 51/170 T |

*Primary Examiner*—Philip R. Coe
*Assistant Examiner*—K. L. O'Leary
*Attorney, Agent, or Firm*—Dodge, Bush & Moseley

[57] ABSTRACT

An improved high-speed floor treating machine is provided comprising a frame, a control and guiding handle extending rearwardly of the frame and an electric motor for rotating a floor contacting pad is secured. The improvement of this invention includes an elongated low clearance extension member secured to the frame. The vertical axis of the forward shaft may be offset from the frame longitudinal axis by angular rotation of the extension member with respect to the frame. The floor contacting pad extends radially beyond the extension member for providing ease of access to difficult treating areas. An alternative embodiment of the invention comprises a novel baseboard floor contacting pad attached to the forward shaft of a modified extension member.

5 Claims, 3 Drawing Sheets

FLOOR AND BASEBOARD TREATING MACHINE

BACKGROUND OF THE INVENTION

1. Field of the Invention

This invention relates generally to a floor treating machine and, more particularly, to a floor and/or baseboard treating machine for cleaning areas difficult to reach or not effectively cleaned by larger machines.

2. Description of the Prior Art

There are machines in common use for cleaning and treating floors including center weighted machines and divided weight machines.

CENTER WEIGHTED MACHINES

Some electrical motor drive floor treating machines rotate a horizontal disc with a treating pad of greater than 15 inches. The pad rotates at less than 400 rpm, and usually, at about 300 rpm. These machines are center weighted so that the total surface of the pad engages the floor. The pad therefore supports the whole weight of the machine. The pressure per square inch is distributed over the whole area of the pad. These machines are usually moved from side to side during their operation.

DIVIDED WEIGHT MACHINES

There are also divided weight floor machines where weight on the brush or other treating pad is reduced by supporting most of the weight on wheels. Such a machine is shown in U.S. Pat. No. 4,122,576 to Bevington et al. issued Oct. 31, 1978. The Bevington high speed machine has a pad greater than fifteen (15) inches in diameter which rotates over 600 rpm and, preferably, above 1000 rpm.

The rotating pad of the above conventional treating machines do not effectively treat difficult to reach areas such as adjacent a wall because (1) the pad housing does not clear restrictive overhanging structures or restrictive corners, (2) the periphery of the large pad exerts less downward pressure so that scrubbing, buffing, polishing or other treating effectiveness is lessened or (3) the side to side movement of the center weighted machines is difficult to position adjacent the wall.

The result of the above ineffective treating is a border of approximately 2½ to 3 inches adjacent a wall baseboard. The custodian must either manually complete the work or not treat the floor and leave an unfinished look together with inadequate floor surface protection.

Therefore, the cleaning industry has long sought a special and unique machine for effectively and efficiently cleaning vinyl, marble, hardwood, terrazo, concrete and other type floors adjacent the baseboard. Moreover, a special machine for cleaning the floor adjacent to and including the baseboard is highly desired by the cleaning industry.

IDENTIFICATION OF THE OBJECT OF THE INVENTION

An object of the invention is to provide an improved floor treating machine for cleaning difficult to reach areas where larger machines are ineffective.

It is another object of this invention to provide a floor treating machine which reduces labor, which is a major cost component in the cleaning industry.

It is another object of this invention to provide a floor treating machine which provides a relatively small treating pad on an offset low clearance extension member to provide ease of access to difficult cleaning areas.

Another object of this invention is to provide a floor treating machine having an offset floor contacting means on an extension member to allow straight line cleaning movement of the treating machine while cleaning adjacent to and including the baseboards.

The further object of this invention is to provide a treating machine which pulls the baseboard contacting means into and along the floor at the baseboard by combining predetermined rotation and offset positioning of the baseboard contacting means.

Finally, it is an object of the invention to provide a floor treating machine having variable cleaning force achieved by upward force of the control handle providing a mechanical advantage to the operator for distributing a majority of the weight of the machine to the front floor contacting means.

SUMMARY OF THE INVENTION

According to the invention, a high-speed floor treating machine is provided comprising a frame having at least two spaced non-marking skids, rollers, or wheels; a control and guiding handle extending rearwardly of the frame; an electric motor mounted on the frame for rotating a floor contacting means and the floor contacting means rotating at a high speed.

The improvement of this invention comprises an elongated low clearance extension member having its first end secured to the frame. The floor contacting means is secured to the second end of the extension member. A vertical axis of the floor contacting means is offset from a frame longitudinal axis. The floor contacting means while less than 7 inches in diameter extends radially beyond the second end of the extension member for providing ease of access to difficult treating areas.

Additionally, the improvement comprises a means for movably mounting the extension member with the frame. The floor contacting means is movable relative to the frame longitudinal axis. The contacting means is movable between an aligned position, wherein the floor contacting means vertical axis is aligned with the frame longitudinal axis, and an offset position, wherein the floor contacting means vertical axis is offset from the frame longitudinal axis for providing ease of access to difficult treating areas. Additionally, means interengaged with the frame and the extension member are provided for controlling relative movement of the extension member to the frame.

An alternative embodiment of the invention comprises a baseboard contacting means being secured to the offset extension member along with the floor contacting means for simultaneously treating both the floor and the baseboard.

BRIEF DESCRIPTION OF THE DRAWINGS

The objects, advantages and features of the invention will become more apparent by reference to the drawings which are appended hereto and wherein like numerals indicate like parts wherein an illustrative embodiment of the invention is shown, of which.

DESCRIPTION OF THE PREFERRED EMBODIMENTS

A. The Frame

Figure 2:
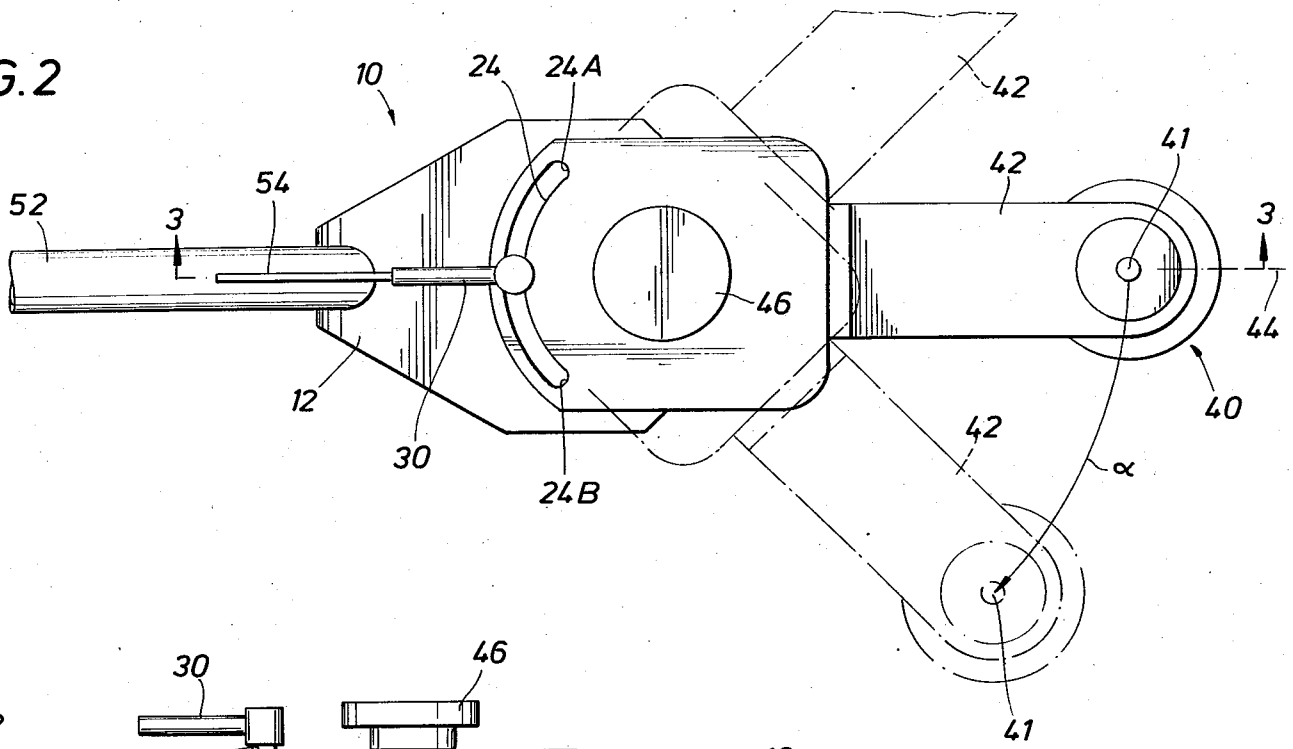
FIG. 2 is a plan view of the floor treating machine with the floor contacting means shown in the aligned position in solid lines and the offset positions in phantom view.

Both the preferred and alternative embodiments of this invention shown in FIGS. 1–7 include a high-speed treating machine 10 having a frame or base plate 12. A mounting plate 14 is pivotably connected to the base plate 12 by means of a pivot stud 16 secured by a flat washer 18 and binder head screw 20.

Figure 3:
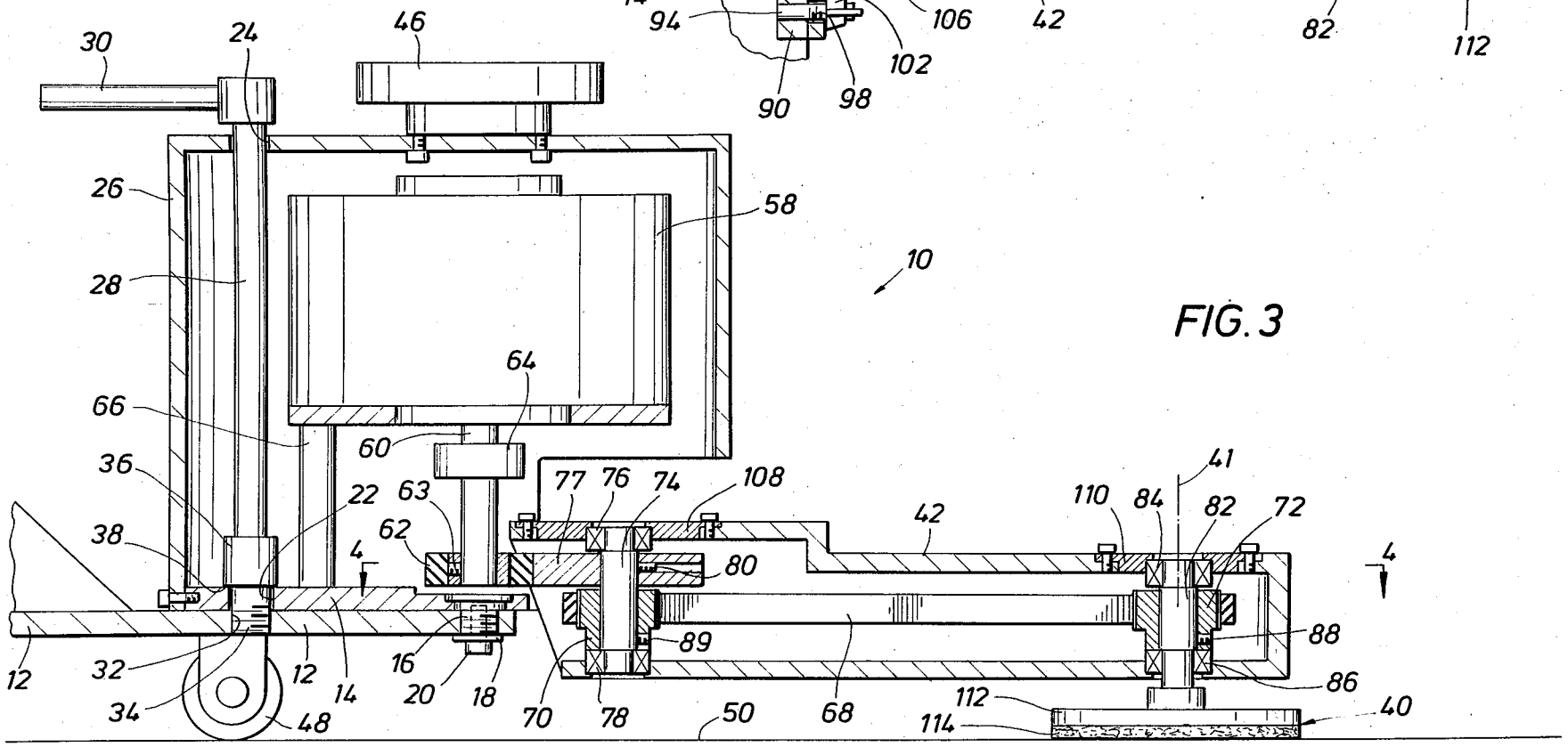
FIG. 3 is a sectional view of the invention taken along lines 3—3 of FIG. 2.

The mounting plate 14 includes a curved slot 22 therein for controlling the pivotable movement of the mounting plate 14 relative to the base plate 12. An identically curved slot 24 is preferably located in the top of a motor housing 26 for allowing passage of a pivot lock shaft 28, as best shown in FIGS. 2 and 3. The pivot lock shaft 28 has a pivot lock handle 30 secured at its top end for aiding in locking and unlocking of the mounting plate 14.

The base plate 12 includes a threaded aperture 32 therein for receiving a threaded shaft 34 axially connected to the pivot lock shaft 28. The pivot lock shaft 28 further includes, above the threaded shaft 34, a lock cylindrical member 36 having a lock shoulder 38 for locking the mounting plate 14 relative to the base plate 12. The pivot lock handle 30 is turned to lock and unlock the shoulder 38 of the lock member 36 relative to the mounting plate 14. Unlocking allows pivotable movement of the mounting plate 14 relative to the base plate 12 for positioning of the floor contacting means, generally indicated at 40, or the baseboard contacting means, generally indicated at 137, as will be discussed below in detail.

The ends of curved slot 22, preferably identical to the ends 24A and 24B of curved slot 24, in combination with shaft 28 further restricts pivotable movement. The floor or baseboard contacting means is preferably restricted to 45° pivotable movement on each side of the longitudinal axis 44, as best shown in FIG. 2. This pivotable movement enables either the attached floor or baseboard contacting means to be positioned offset for straight line forward or backward cleaning by the machine. The operator is therefore able to achieve the most efficient operation from the machine by this straight line movement.

Preferably, a large diameter plastic pivot knob 46 is secured on the top of the motor housing 26 to enable the operator to manually rotate the motor housing along with its attached extension member to a desired angle $\alpha$. After desired positioning, the pivot handle 30 is locked for operating the machine.

Figure 1:
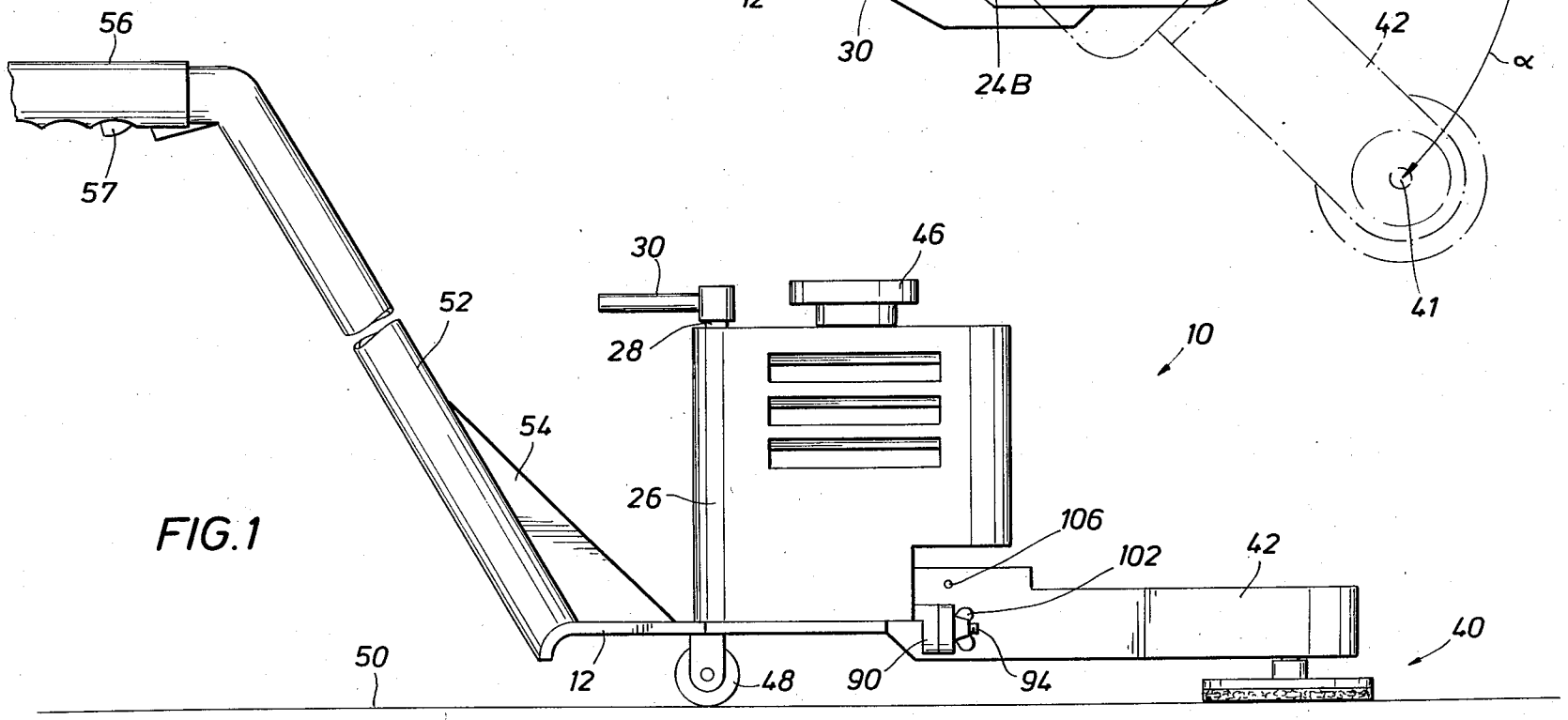
FIG. 1 is a side elevational view of the floor treating machine of the invention with the handle shown in broken view.

Beneath and adjacent the rear of the base plate 12 are at least two non-marking wheels. Only one wheel 48 contacting floor 50 is shown. Preferably two parallel and axially aligned wheels extend downwardly from the bottom of base plate 12, as best shown in FIGS. 1 and 3, to aid in straight line movement of the machine 10. Thus forward and backward straight line movement of the machine 10 in the direction of the longitudinal axis 44, as shown in FIG. 2, may be easily accomplished by use of the guiding handle 52.

Devices for raising and lowering the wheels are known to those of ordinary skill in the art. U.S. Pat. No. 4,122,576 to Bevington et al. discloses a raising and lowering device for the wheels and is incorporated herein for that disclosure and for all other essential material.

B. The Control and Guiding Handle

At the rear of the frame 12, a flange 54 is preferably used to fixedly secure the handle 52 to the frame or base plate 12. The handle 52 is preferably angled at 60° from the floor 50, though other angles and securement means may be used.

At the upper end of the guiding handle 52 is a rearwardly extending hand grip 56 having a 15 ampere trigger switch 57, similar to the switch manufactured by Black & Decker for its electric edger. The switch 57 remotely starts and/or engages the motor 58.

Intermediate the ends of the handle 52 there may be provided one or more pair of diverging wing brackets between which the electric cable (not shown) may be wound for storage when the machine is not in use. One end of the cable may be extended through the hollow handle 52 and the motor housing 26 for connection to the electric motor 58. The free end of the electric cable is provided with a conventional plug which may be plugged into any standard 110–120 volt AC circuit outlet socket.

Preferably, the handle 52 disassembles at the midpoint for shipping and/or storing purposes.

C. The Motor

The motor 58, as shown in FIG. 3, is preferably a one-quarter ($\frac{1}{4}$) horsepower capacitor start high torque electric motor with provisions for a cooling fan (not shown). The motor 58 and its associated drive means are capable of rotating the contacting means at 780 rpm.

The motor is directly mounted in the vertical position to the mounting plate 14 and therefore to the frame base plate 12. A motor shaft 60 extends downwardly from the motor 58 and preferably has a urethane drive wheel 62 secured at one end by fastener 63. A centrifugal type clutch 64 may be used in the invention in the event that the motor 58 is required to obtain sufficient speed before engagement.

The motor 58 is secured to the movable mounting plate 14 by means of a bracket 66 or any other suitable means. This securement allows the motor to be pivoted with the mounting plate 14 relative to the base plate 12.

D. The Drive mechanism

The above detailed description discloses features of the present invention which can be used for both the preferred and alternative embodiment. Below Sections D. and E. relate only to FIGS. 1–4 illustrating the preferred embodiment.

The drive mechanism for the floor contacting means 40 shown in FIGS. 1–4 comprises a belt 68 disposed between a rear pulley 70 and a front pulley 72, all disposed in extension member 42. The rear pulley 70 is coaxially secured to a rear shaft 74 journalled between upper bearing 76 and lower bearing 78 set in the extension member 42. A steel roller 77 is preferably disposed above the rear pulley 70 on the shaft 74 for operable engagement and horizontal alignment with the urethane drive wheel 62. A fastening means 80 is provided in the steel roller 77 to prevent inadvertent slippage or rotation of the steel roller relative to the rear shaft 74.

Likewise, the front pulley 72 is coaxially secured to a front shaft 82 journalled between a top bearing 84 and a lower bearing 86 in the second end of the extension member 42. A fastening means 88 is provided on the front pulley 72 similar to a fastening means 89 in the rear pulley 70 for preventing inadvertent slippage or rotation of the pulley relative to their respective shafts.

Although a preferred drive means is illustrated between the floor contacting means and the motor, other drive means may be employed including gears or different speed adjustment mechanisms. In general, the faster the floor contacting means 40 rotates, the quicker and better the floor 50 is cleaned, polished, or treated.

Figure 4:
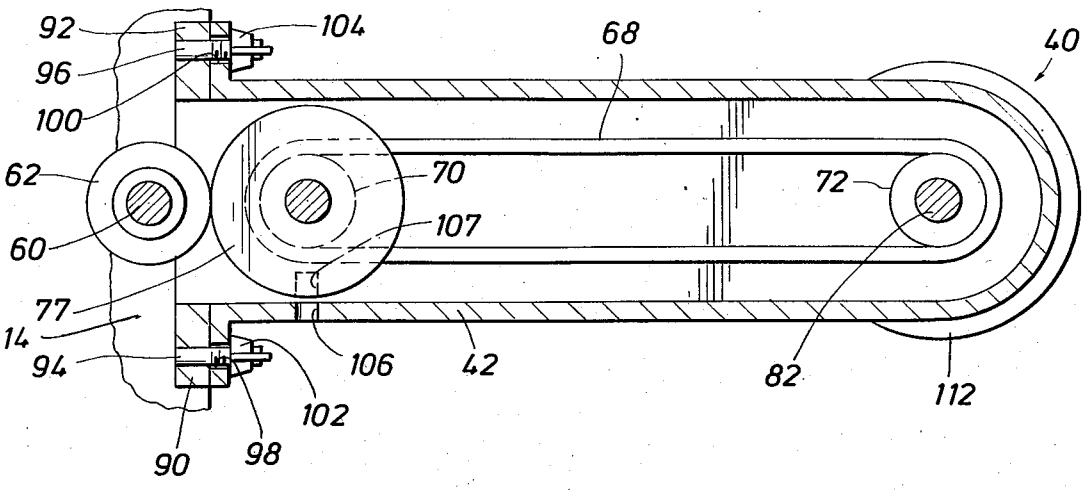
FIG. 4 is a sectional taken along lines 4—4 of FIG. 3.

To secure the extension member 42 and its associated drive mechanisms to the mounting plate 14, flanges 90 and 92 of plate 14 are provided, as best shown in FIG. 4. Flanges 90 and 92 have respective bolts 94 and 96 provided on each side of urethane drive wheel 62. Aligned holes 98 and 100 of extension member 42 receive the respective bolts 94 and 96. The tightening of wing nuts 102 and 104 on respective bolts 94 and 96 operably engages the steel roller 77 of the extension member 42 to the urethane power drive wheel 62; as best shown in FIGS. 3 and 4.

As best shown in FIGS. 1 and 4, a locking pin 106 is received in aperture 107 in the steel roller 77. The pin 106 in the locked position prevents rotation of the steel roller 77 and therefore the floor contacting means 40. This locking mechanism allows changing of an assortment of pads without rotation of the floor contacting means 40.

Inspection plates 108 and 110 are located above the rear shaft 74 and the front shaft 82, respectively, for periodic maintenance of the drive means in the extension member 42.

E. The Floor Contacting Means

The floor contacting means 40, as shown in FIGS. 3 and 4, comprises a backing pad 112 connected to shaft 82 onto which a treating pad 114 may be secured. Preferably the pad 114 is 3 to 5 inches in diameter. The pad 114 is positioned on the extension member 42 so as to extend radially beyond the second end of the extension member 42. Because of the relative small diameter of pads 112 and 114, effective cleaning may be accomplished adjacent the wall baseboard and in corners. Additionally, the clearance required for both the cleaning pad 114 and the extension member 42 is approximately 2½ inches. The rotational speed of the pad, as discussed previously, is approximately 780 rpm.

Pad 114 may be cut from 3M type material and attached to a permanently fastened hook portion (not shown) on backing pad 112, as commonly used in the "VELCRO" hook and loop connector. The pads 114 are preferably color coded to enable the operator to distinguish between heavy duty jobs and very light jobs. The use of the "VELCRO" hook and pile system enables secure operating performance of the floor treating machine pad without complicated manual fastening efforts.

Various pads 114 and backing pad 112 can be provided to enable different functions such as sanding hardwood floors, spot scrubbing carpets, and grinding of stone type floors. A special pad 114 may be attached to allow the treating portion of the pad to extend up the rim of the backing pad 112 to provide treating up the baseboard for a certain distance, preferably about an inch.

The alternative embodiment of the present invention simultaneously performs the floor and baseboard treating function to heights greater than one inch up the baseboard.

It is envisioned that the preferred and alternate embodiment of the present invention could be a self-contained machine using batteries for an electric direct current motor, as disclosed in the above Bevington patent.

F. Floor and Baseboard Contacting Means

Figure 5:
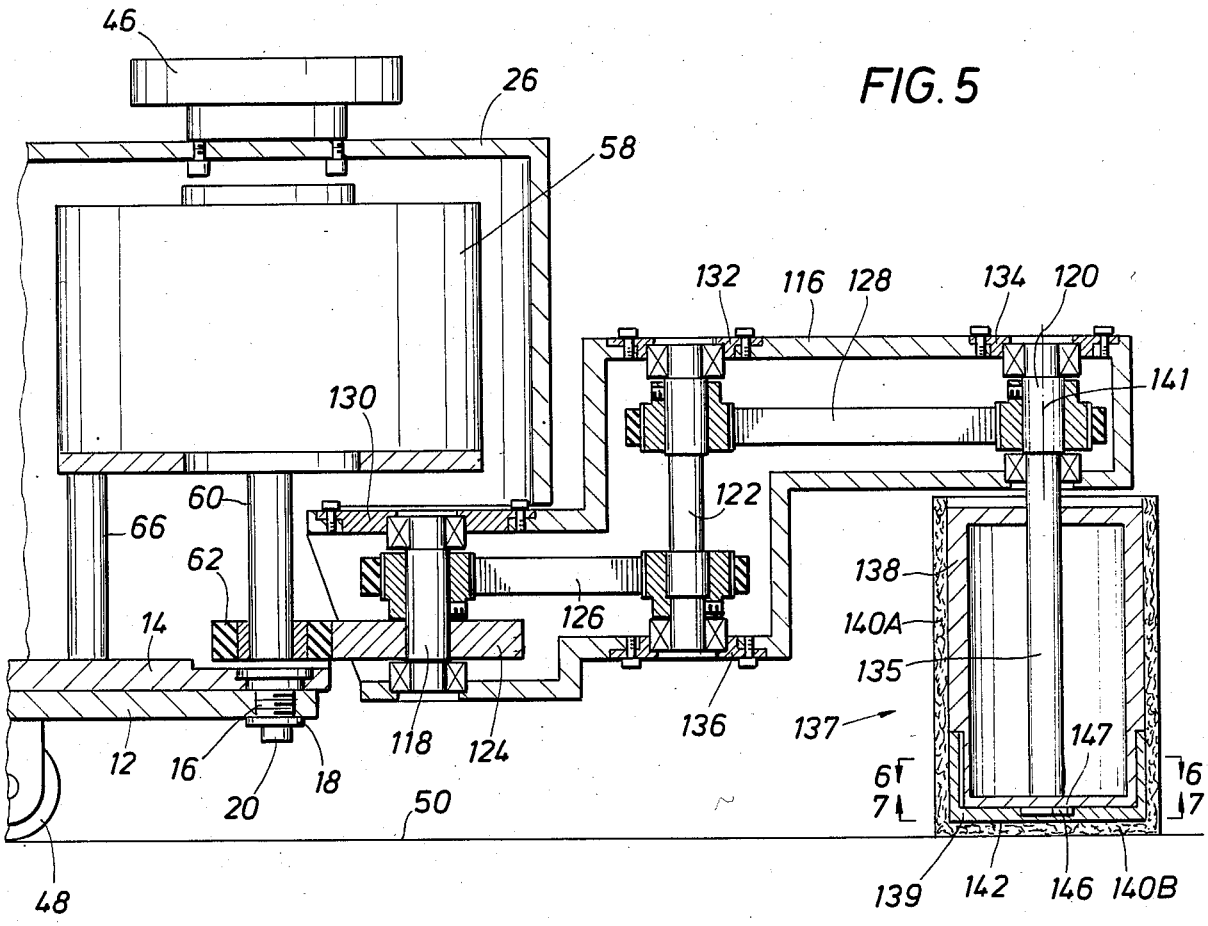
FIG. 5 is a sectional elevational view, similar to FIG. 3, showing an alternative embodiment of the present invention.
Figure 6:
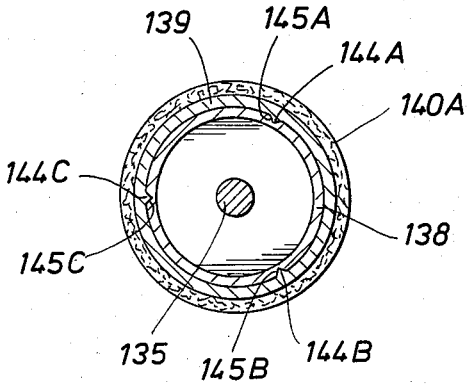
FIG. 6 is a sectional view taken along lines 6—6 of FIG. 5.
Figure 7:
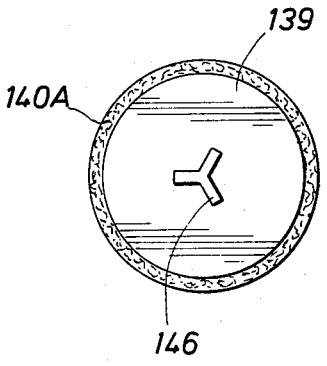
FIG. 7 is a sectional view taken along lines 7—7 of FIG. 5.

A floor and baseboard alternative embodiment comprises a floor/baseboard contacting means secured to an extension member 116, as best shown in FIGS. 5–7. The extension member 116 of FIG. 5 is secured to flanges 92 and 90 of mounting member 14, as in FIG. 4, by first removing wing nuts 104 and 102, removing extension member 42, and then securing extension member 116 about bolts 96 and 94 with wing nuts 104 and 102. Therefore, the mounting plate 14, base plate 12 and pivotable mechanism as discussed previously are identical in this alternative embodiment.

The alternate extension member 116 comprises a rear shaft 118, a front shaft 120 and a mid-shaft 122 all being journalled between a pair of bearings similar to extension member 42. The rear shaft 118 includes a steel roller 124, similar to steel roller 77 of extension member 42, to operably engage the urethane drive wheel 62 powered by motor 58. The rotation of the steel roller 124 rotates mid shaft 122 by belt 126 which in turn rotates the front shaft 120 by means of belt 128.

Inspection plates 130, 132, 134, and 136 are provided on extension member 116 similar to inspection plates 108 and 110 of extension member 42. Also a locking pin for roller 124, similar to locking pin 106, may be provided in extension member 116.

The floor/baseboard contacting means 137 is uniquely fabricated to provide the operator with the ability to specifically treat the floor with a pad 140B having diameters of 3 to 5 inches, similar to treating pad 114, while treating the baseboard to variable heights of 2 to 5 inches with pad 140A.

A rotating plastic drum 138 is provided on a downwardly directed rod 135 of front shaft 120. Drum 138 receives a cylinder shaped plastic can 139 having treating pad 140A secured thereon, as best shown in FIGS. 5–7. This novel rotating drum 138 and pad 140 prevents cleaning fluids from being thrown up on the walls above the baseboards.

Below the second end of the extension member 116 is approximately 6 inches of clearance to position the rotating drum 138. The preferred drum 138 has a fixed height of approximately 5 inches and is preferably equipped with a three inch diameter floor cleaning head 142. Additionally, drums having cleaning heads of 5 inches in diameter and 5 inches in height may be used. The different heights of drums are provided to properly treat the baseboard without extending above and soiling the wall coverings.

The preferred drum 138 has grooves 144A, 144B, and 144C onto which corresponding V-shaped ribs 145A, 145B and 145C on the plastic can 139 are received. The grooves and ribs prevent inadvertent slippage of the can 139 during rotation of the drum 138. The cylindrical treating pad 140A and the circular bottom treating pad 140B are preferably bonded together and to plastic can 139.

As shown in FIGS. 5 and 7, the plastic can 139 also has a molded male detent 146 to interface with a female detent portion 147 in the bottom of the drum 138. This insures final alignment and prevents rotation without the need for the previously described "VELCRO" connector.

The pad 140A materials for the treating of baseboards is normally less aggressive than that required for the floor pad 140B. Consequently, two different type of pad material may be incorporated onto the plastic can 139 slipped over the drum 138.

G. Summary

Instead of moving the machine from side to side, the present invention allows the operator to walk forward in a straight line with the machine 10. The rotation action of the offset baseboard contacting means 137 on the baseboard will desirably aid in pulling the machine 10.

Because of the low clearance of extension members 42 and the small diameter of floor contacting means 40 ease of access to difficult cleaning areas is provided.

The present invention machine preferably has a height from the top of the plastic knob 46 to the floor 50 of approximately ten (10) inches. The distance from the centerline of the wheel to the vertical axis 41 on the floor contacting means 40 or vertical axis 141 of the floor/baseboard contacting means 137 in the aligned position is preferably thirteen and one half (13½) inches.

The total weight of the machine 10 is approximately thirty-five (35) pounds. During operation of the machine 10 the total weight on the wheels is only fifteen (15) pounds with the remaining twenty (20) pounds being placed on the treating pad 114 or 140. This weight distribution is achieved by the mechanical advantage provided by the handle 52 to the operator. The width of the base plate 12 is seven (7) inches.

Various modifications and alterations in the disclosed apparatus will be apparent to those skilled in the art of the foregoing description which does not depart from the spirit of the invention. For this reason, these changes are desired to be included in the appended claims. The appended claims recite the only limitation to the present invention and the descriptive manner which is employed for setting forth the embodiments and is to be interpreted as illustrative and not limitative.

What is claimed is:

1. A machine for treating a floor comprising:

a frame base plate defining a longitudinal axis, a guiding and control handle attached to said frame base plate, a pair of laterally spaced rollers secured to said frame base plate for at least partially pivotally supporting said machine with respect to the floor, a mounting plate disposed on said frame base plate, a drive motor carried by said mounting plate, an elongated extension member secured at one end to said mounting plate and having at its other end a treating head means, said treating head means for rotatingly treating the floor and at least partially supporting said machine with respect to the floor, means for transmission of rotation of said drive motor to said treating head means, and securing means for angularly varying said mounting plate with respect to said frame base plate such that said mounting plate and said treating head means of said elongated extension member may be variably angularly oriented within an arc extending from both lateral sides of said longitudinal axis, whereby the weight of said drive motor is at least partially transferred to said treating head means via said mounting plate and said elongated extension member.

2. The machine of claim 1 wherein said securing means comprises:

a curved slot disposed in said mounting plate, an aperture in said base plate, and shaft means disposed in said mounting plate slot and said base plate aperture for controlling relative angular movement of said mounting plate with respect to said base plate.

3. The machine of claim 2 further comprising means for locking said base plate relative to said mounting plate.

4. The machine of claim 1 wherein said treating head means includes a vertical shaft, a backing pad secured to said vertical shaft, and a treating pad attached to said backing pad by a hook and loop connector.

5. The machine of claim 1 wherein said treating head means includes a vertical shaft, a cylindrical drum attached to said shaft, a floor treating pad attached to the bottom of the drum for treating the floor, and a baseboard treating pad attached to the periphery of the drum for treating a baseboard, wherein, said treating head enables simultaneous treatment of a baseboard and a floor surface immediately adjacent the baseboard.

* * * * *